United States Patent [19]

Shagarova et al.

[11] Patent Number: 4,747,551

[45] Date of Patent: May 31, 1988

[54] DISINTEGRATING ROTOR

[76] Inventors: Bella U. Shagarova; Olev G. Reemet, both of Mustamyae tee, 149, kv. 113; Evgenia E. Ostapenko, Yismyae tee, 6, kv. 85; Vladimir M. Matveev, Mustamyae tee, 169, kv. 54, all of, Tallin, U.S.S.R.

[21] Appl. No.: 915,250

[22] PCT Filed: Jan. 17, 1985

[86] PCT No.: PCT/SU85/00002

§ 371 Date: Sep. 5, 1986

§ 102(e) Date: Sep. 5, 1986

[87] PCT Pub. No.: WO86/04266

PCT Pub. Date: Jul. 31, 1986

[51] Int. Cl.[4] ..... B02C 13/22; B02C 13/28

[52] U.S. Cl. ..... 241/188 R; 241/188 A; 241/197; 241/300

[58] Field of Search ..... 241/188 A, 188 R, 195, 241/197, 300

[56] References Cited

U.S. PATENT DOCUMENTS

| | | | |
|---|---|---|---|
| 3,503,561 | 3/1970 | Johnson | 241/197 X |
| 3,612,420 | 10/1971 | Hull | 241/197 X |
| 4,307,845 | 12/1981 | Larimer et al. | 241/197 X |

FOREIGN PATENT DOCUMENTS

| | | | |
|---|---|---|---|
| 692602 | 5/1940 | Fed. Rep. of Germany | 241/197 |

*Primary Examiner*—Timothy V. Eley
*Attorney, Agent, or Firm*—Burgess, Ryan & Wayne

[57] ABSTRACT

A disintegrating rotor comprising disks (1) carrying beaters (2) having a hard-faced working surface (4) that is formed by inserts (5 and 6) made from different wear-resistance materials and fitted so that harder inserts are found near the center of the beater (2) and softer inserts, to the periphery.

5 Claims, 3 Drawing Sheets

DISINTEGRATING ROTOR

TECHNICAL FIELD

The present invention relates generally to devices for disintegrating, intermixing and activating of materials and more specifically to disintegrating rotors.

BACKGROUND ART

Widely known in the present state of the art are rotors comprising disks installed opposite each other and carrying concentrically disposed impact elements (cf., U.S. Pat. No. 3,047,243, Int.Cl. B 02c published in 1962).

In prior-art rotors the working surface of the beater elements wears substantially unevenly. This is explained by the fact that the velocity of the material as it strikes the beater element is much higher than the velocity of the material moving along the working surface of the beater element caused by centrifugal forces. Because of this, the portion of material being processed by the beater working surface fails to be removed completely from its surface by the time a fresh portion of material comes in to be processed. As a result, part of the material tends to stick to the working surface at locations more distant from the center of rotation of the rotor whereas the working surface area adjacent to the center of rotation of the rotor tends to be exposed. Every fresh portion of the inflowing material lands on the exposed beater working surface at locations near by the center of rotation of the rotor, and on a layer of material protecting the beater surface from wear, at the beater periphery.

Besides, particles of the material being hurled on the beater working surface are affected by aerodynamic drag with the result that the velocity of their impingement upon the beater surface is less, due to a longer path of travel, at the beater periphery than at locations near the center of rotation of the rotor.

For the reasons given above, the beater working surface will wear unevenly and the portion adjacent to the center of rotation of the rotor will wear faster than that at the beater periphery. This brings about a change in the profile of the working surface and, hence, in the angle of impingement of particles of the material upon the beater working surface which leads to changes in the grain size composition of the finished product.

Attempts have been made to extend the beater service life by hardening its working surface at the extreme points and at the center thereof (cf., accepted Application No. 2,319,810, Federal Republic of Germany, Int. Cl.$^2$ B 02c 13/22).

However, such a hardening fails to prevent distortions of the working surface profile resulting from variable intensity of the abrasive action produced by feed on the hard-faced portions made of the same material.

Besides, the hard-faced member secured closest to the center of rotation of the rotor is so disposed that the less wear-resistance material, wherein it is held is subjected to rapid wear with attendant fallout of the said member.

DISCLOSURE OF THE INVENTION

The present invention is aimed at the provision of a disintegrating rotor wherein the beater working surface would be made in such a way as to maintain profile of the working surface unchanges in the course of regular service and, consequently, to ensure consistent grain size composition of the finished product.

The above-said object is accomplished due to the fact that in a disintegrating rotor comprising disks installed opposite each other and carrying concentrically disposed beaters having hard-faced working surface, according to the invention the hard-faced working surface being made of different wear-resistance materials so that harder wear-resistance materials are found closer to the center of the beater and softer materials, closer to the periphery.

The arrangement of different wear-resistance materials in such a way that harder materials are found closer to the center of the beater and softer materials are more distant from it allows the profile of the working surface to be maintained unchanged in the course of regular service, since, regardless of the varying intensity of the abrasive action produced by feed on the different portions of the working surface, the latter will wear substantially evenly over the entire thickness of the beater. This is explained by the fact that in areas of more intensive abrasive action produced by feed the working surface will be faced with more wear-resistance material whereas in the areas subjected to less intensive abrasive action the working surface will be faced with less wear-resistance material. By this means the profile of the working surface is maintained unchanged which ensures consistency of the grain size composition of the finished product.

To render the beater more productioneered and amenable to ready installation and dismantling as well as whenever use is made of hard-to-secure materials it is advisable that the hard-faced working surface should comprise inserts made of different wear-resistance materials and closely fitted to each other so that harder inserts are found closer to the beater center and softer inserts, to the beater periphery. In so doing, care must be taken that at least one of the inserts is removable.

In hardening the working surface by hard-facing or spraying, it is recommended that the hard-faced working surface be formed by layers oriented in a direction close to that of material inflow and be faced with different wear-resistance materials so that harder layers are found near the center of rotation and softer layers, to the beater periphery.

The said layers may be arranged over the entire thickness of the beater. The orientation of layers comprised by different wear-resistance materials in a direction close to that of material inflow on the working surface allows the conditions of interaction of the working surface and feed to be maintained unchanged during operation of the disintegrating device so that beater portions subjected to more intensive abrasive action will be faced with harder wear-resistance material. Besides, such an arrangement of the beater plate which is closest to the center of rotation of the rotor and facing it, minimizes the adverse effect of feed and, consequenlty, wear and beater shape distortions.

The conditions of interaction of the working surface and feed are also maintained unchanged in the case when the beater plate closest to the center of rotation of the rotor is comprised of inserts oriented in a direction close to that of material inflow.

BRIEF DESCRIPTION OF THE ACCOMPANYING DRAWINGS

In what follows the present invention will now be disclosed in a detailed description of an illustrative embodiment thereof with reference to the accompanying drawings, wherein:

FIG. I is a cross-sectional view of a rotor, according to the invention;

Figure 4:
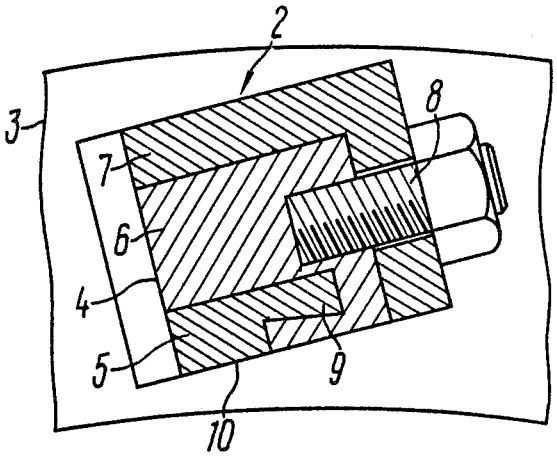
Figure 5:
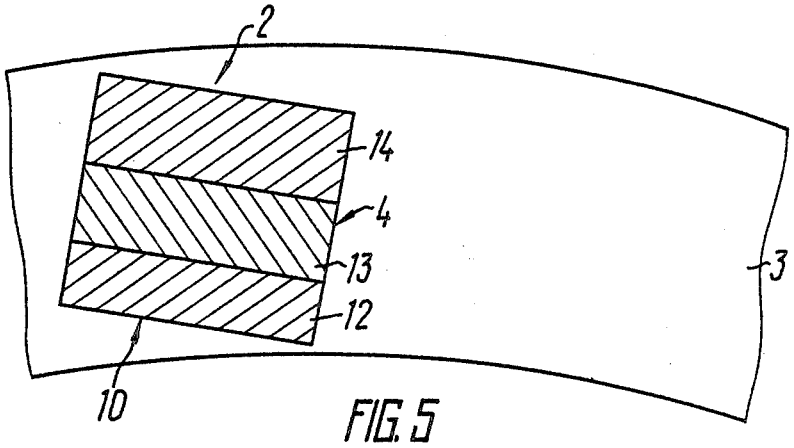
Figure 3:
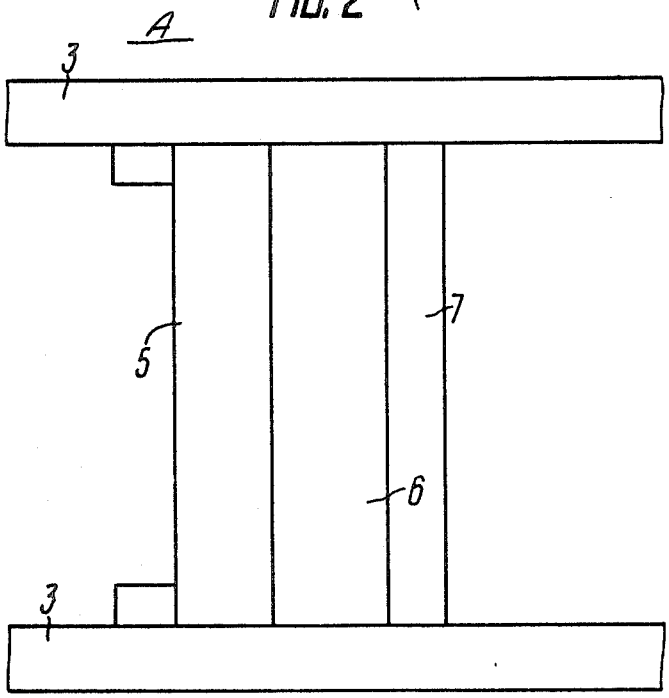
FIG. 3 is a view facing arrow A in FIG. 2.
Figure 3:
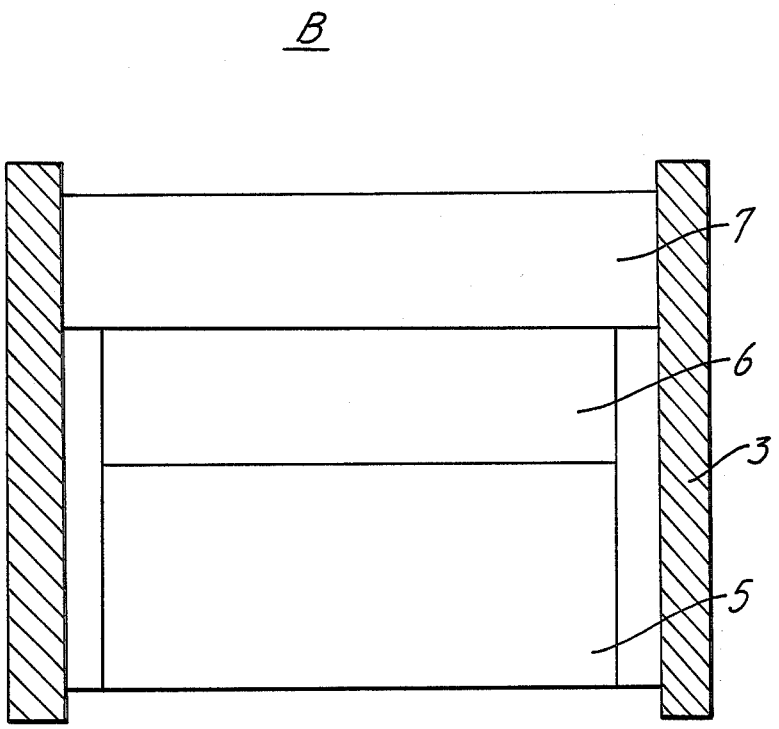

FIG. 3' is a cross sectional view of an embodiment of the rotor beater;

FIG. 4 is a cross-sectional view of an embodiment of the rotor beater;

FIG. 5 is a cross-sectional view of an alternative embodiment of the rotor beater.

BEST MODE OF CARRYING OUT THE INVENTION

Figure 1:
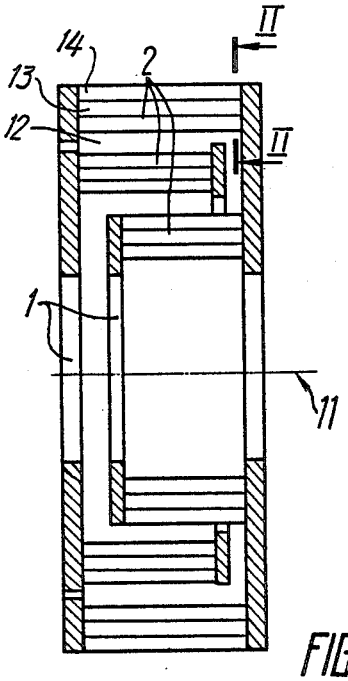
Figure 2:
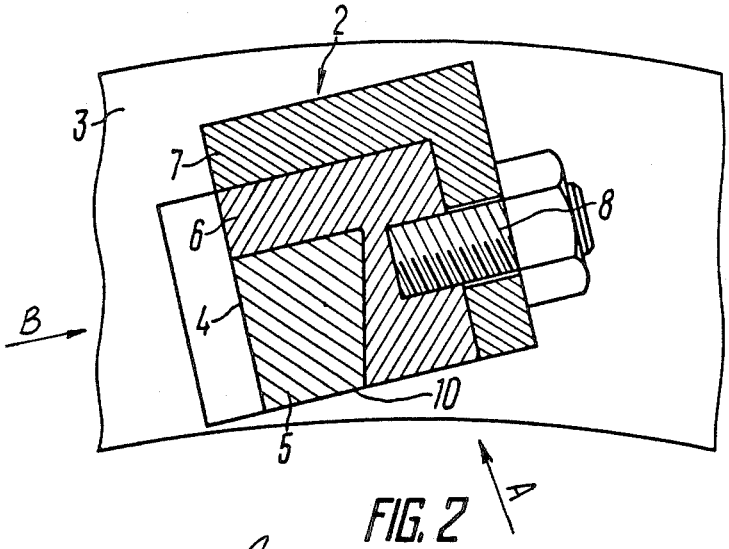
FIG. 2 is a section taken on the line II—II in FIG. I.

The disintegrating rotor is comprised of disks 1 (FIG. 1) installed opposite each other and concentrically disposed beaters 2 held to disks 1 by means of rings 3. The beater 2 has a working surface 4 thereof (FIGS. 2,3) formed by inserts 5 and 6 made of different wear-resistance materials and closely fitted to one another so that harder inserts are fitted closer to the beater center and softer inserts, to the beater periphery, i.e. the material of the insert 5 is more wearresistant than that of the insert 6. The insert 5 is held in the slot provided in the insert 6 whereas the insert 6, in turn, is attached to the ring 3 by means of an L-shaped plate 7 and a holding element 8. Attachment to the ring may be effected through any other known method. FIG. 4 represents an embodiment of the rotor beater having an alternative construction of the inserts. According to this embodiment, an additional projection 9 is provided on the insert 5 for better security of its attachment. A plate 10 of the beater 2, which is closest to a center 11 (FIG. 1) of rotation of the rotor, shown in different embodiments in FIGS. 2–5. Specifically, plate 10 is comprised of the inserts 5,6 (FIGS. 2, 3,4) and oriented in a direction close to that of material inflow on the beater whereby wear and shape distortions are minimized. FIG. 5 represents an embodiment of the working surface 4 formed by a number of layers 12, 13, 14 which make up plate 10 and are made from different wear-resistance materials so that harder layers are found closer to the center of the beater and softer layers, to the beater periphery. The layers 12, 13, 14 are oriented in a direction close to that of material inflow whereby the conditions of interaction of the working surface and feed are maintained unchanged during operation of the disintegrating device.

The herein proposed disintegrating rotor operates as follows.

The portion of feed hurled on the working surface 4 immediately starts moving radially outwardly by the centrifugal forces leaving the insert 5 exposed, the insert 6 still remaining covered by feed before a fresh portion of feed is delivered to the beater 2.

Next, this fresh portion of feed hits the working surface at velocities that are higher in the portion of the working surface 4 formed by the insert 5, and lower in the portion formed by the insert 6. At that instant, the working surface 4 formed by the insert 5 is free from the previously delivered feed whereas the insert 6 still remains covered by it. Because of this, at the instant of impingement the insert 5 is subjected to a more intensive action of feed than the insert 6. However, considering that the insert 5 is made from a more wear-resistance material and the insert 6, from a less wear-resistance material, both of these will wear substantially evenly which enables the original shape of the working surface 4 to be retained. Wear on the working surface 4 formed by the layers 12, 13, 14 made from different wear-resistance materials occurs similarly.

Retention of the original shape of the working surface 4 during operation of the disintegrating device provides consistency of the grain size composition.

The plate 10 of the beater 2 is aligned with the direction of material inflow which minimizes wear and shape distortion thereof caused by its impingement upon the feed.

INDUSTRIAL APPLICABILITY

The herein proposed invention can be used to best advantage in the agriculture, construction, chemical and other industries.

We claim:

1. A disintegrating rotor having a center of rotation and a periphery comprising:

disks mounted for rotation about a common axis and in opposing relation to each other;

beaters concentrically positioned about said disks, each beater having a periphery and a hard-faced working surface;

characterized in that each hard-faced working surface is formed by a plurality of materials having different wear-resistances, with said materials having a greater wear-resistance being positioned closer to the center of rotation of said rotor and said materials having a lesser wear-resistance being positioned closer to the periphery of the rotor.

2. A disintegrating rotor as claimed in claim 1; characterized in that each hard-faced working surface is formed by a plurality of inserts made of different wear-resistance materials and closely fitted to one another so that inserts having a greater wear-resistance are positioned near the center of rotation of said rotor and inserts having a lesser wear-resistance are positioned near the rotor periphery.

3. A disintegrating rotor as claimed in claim 2; characterized in that at least one of the inserts is removable.

4. A disintegrating rotor as claimed in claim 2; wherein characterized in that the surface of the more resistant material of the hard-faced working surface of said beater nearest the center of rotation of the rotor is oriented in a direction close to that of a direction of inflow of material.

5. A disintegrating rotor as claimed in claim 1; characterized in that the hard-faced working surface is formed by a plurality of layers made from different wear-resistance materials and oriented in a direction close to that of a direction of material inflow so that layers having a greater wear-resistance are positioned near the center of rotation of the rotor and layers having a lesser wear-resistance are positioned near the rotor periphery.

* * * * *